United States Patent [19]

Jarmin et al.

[11] Patent Number: 4,475,716

[45] Date of Patent: Oct. 9, 1984

[54] HEIGHT ADJUSTABLE TOWER MOUNTED PULL ASSEMBLY

[76] Inventors: Davis R. Jarmin, 610 Ward Dr.; Virgil H. Hinson, 206 Fairway Oaks Dr., both of Brunswick, Ga. 31520

[21] Appl. No.: 427,528

[22] Filed: Sep. 28, 1982

[51] Int. Cl.[3] ..... B21D 1/00; B25B 25/00

[52] U.S. Cl. ..... 254/228; 72/447; 72/705; 254/263

[58] Field of Search ..... 254/201, 209, 228, 244, 254/247, 252, 256, 257, 262, 263; 72/308, 447, 705

[56] References Cited

U.S. PATENT DOCUMENTS

| | | | |
|---|---|---|---|
| 3,566,666 | 3/1971 | Berendt | 72/705 X |
| 3,698,230 | 10/1972 | Buske | 72/705 X |
| 3,796,084 | 3/1974 | Jarman | 72/447 |
| 3,893,329 | 7/1975 | Roes | 72/705 X |

FOREIGN PATENT DOCUMENTS

| | | | |
|---|---|---|---|
| 1373287 | 12/1974 | United Kingdom | 72/705 |

*Primary Examiner*—Stuart S. Levy
*Assistant Examiner*—Katherine Jaekel
*Attorney, Agent, or Firm*—Harvey B. Jacobson

[57] ABSTRACT

An upstanding post is provided having a follower guidingly mounted thereon for adjustable positioning therealong. A pull lever is pivotally supported at one end from the follower for limited oscillation about a horizontal axis transverse to the lever and the lever is disposed in position generally paralleling the post. The other end of the lever is notched for engagement with successive links of a pull chain and an elongated longitudinally extendable thrust member has one end anchored relative to the follower and the other end engaged with the lever at a point spaced from its axis of oscillation for angularly displacing the lever away from the first end of the thrust member. The follower includes anchor structure disposed in the plane of swinging movement of the lever and spaced horizontally from the latter in the direction opposite to the direction in which the thrust member is operative to displace the lever. The anchor structure carried by the follower is operative to engage selective links of the chain and the lever and the end of the thrust member engaged with the lever include coacting structure whereby the thrust member may be engaged with the lever at points spaced longitudinally therealong. The upper end of the post and the follower each include structure for establishing an inclined tension brace extending therebetween and a lower anchor point such as a floor mounted anchor.

6 Claims, 7 Drawing Figures

Fig. 1
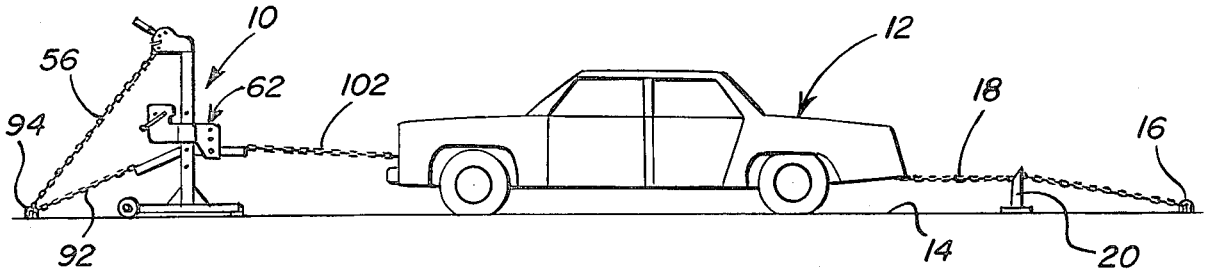
Fig. 2
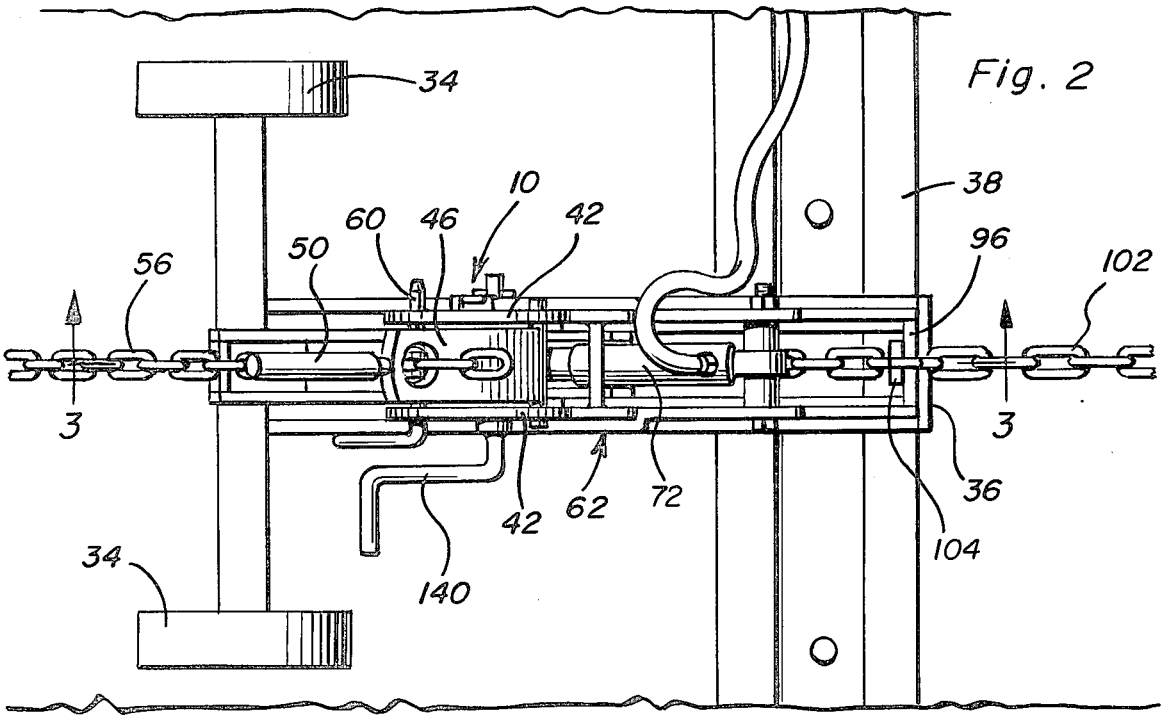
Fig. 4
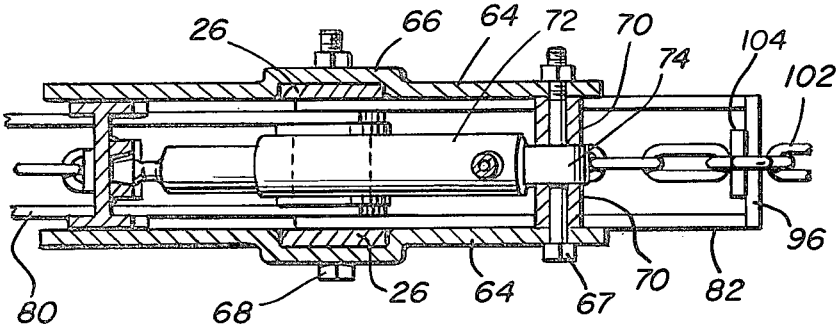
Fig. 5
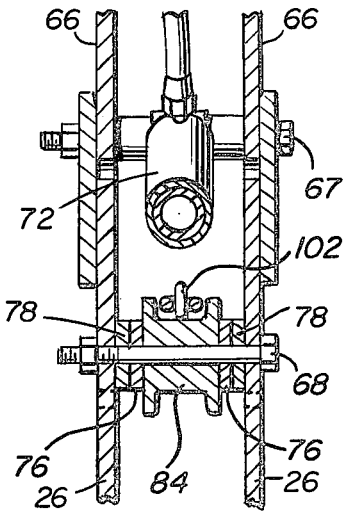
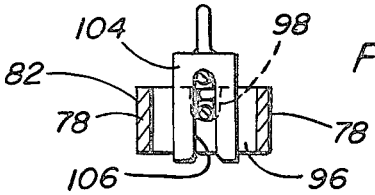
Fig. 6

HEIGHT ADJUSTABLE TOWER MOUNTED PULL ASSEMBLY

BACKGROUND OF THE INVENTION

When straightening conventional vehicle frames or unibody frames it is often necessary to exert horizontal pulls at various elevations. Although frame straightening machines capable of performing such horizontal pulls at various elevations heretofore have been provided, most of these frame straightening machines are very complex and expensive. Accordingly, a need exists for a simplified pull assembly which may be readily floor anchored and utilized to exert a horizontal pull at various different elevations.

BRIEF DESCRIPTION OF THE INVENTION

The pull assembly of the instant invention includes a post having support means at its lower end for support from a floor and for anchoring in position relative to the floor. A follower is mounted on the post for guided vertical movement therealong and the upper end of the post and the follower include structures for forming adjustable length varied angle inclined tension braces between the follower and the post upper end and a floor relative to which the lower end of the post is anchored. In addition, the follower includes thrust means for exerting a horizontal pull on a tension chain or the like at elevations corresponding to the elevation of the follower. The thrust means is constructed in a manner whereby successive short pulls on a tension member such as a chain may be readily effected through the utilization of a relatively short stroke hydraulic cylinder.

The main object of this invention is to provide a pull assembly which may be effectively used to exert horizontal pulls on vehicle frame and body portions at selected elevations.

Another object of this invention is to provide a pull assembly in accordance with the preceding object and which may be used independent of a relatively complex and expensive frame straightening machine.

Still another important object invention of this invention is to provide a pull assembly which may be utilized in conjunction with various different forms of floor anchors.

Another object of this invention is to provide a pull assembly including a hydraulic cylinder-type thrust member selectively engageable with different longitudinally spaced points along a thrust lever whereby the force effected by the thrust member on the pull lever may be varied.

A final object of this invention to be specifically enumerated herein is to provide a pull assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view illustrating the pull assembly of the instant invention in operative association with a vehicle for effecting a horizontal pull on a body or frame portion of that vehicle;

FIG. 2 is an enlarged top plan view of the pull assembly;

FIG. 4 is a horizontal sectional view taken substantially upon the plane indicated by the section line 4—4 of FIG. 3;

FIG. 5 is a fragmentary vertical sectional view taken substantially upon the plane indicated by the section line 5—5 of FIG. 3;

FIG. 6 is a vertical sectional view taken substantially upon the plane indicated by the section line 6—6 of FIG. 3.

DETAILED DESCRIPTION OF THE INVENTION

Figures 3, 7:
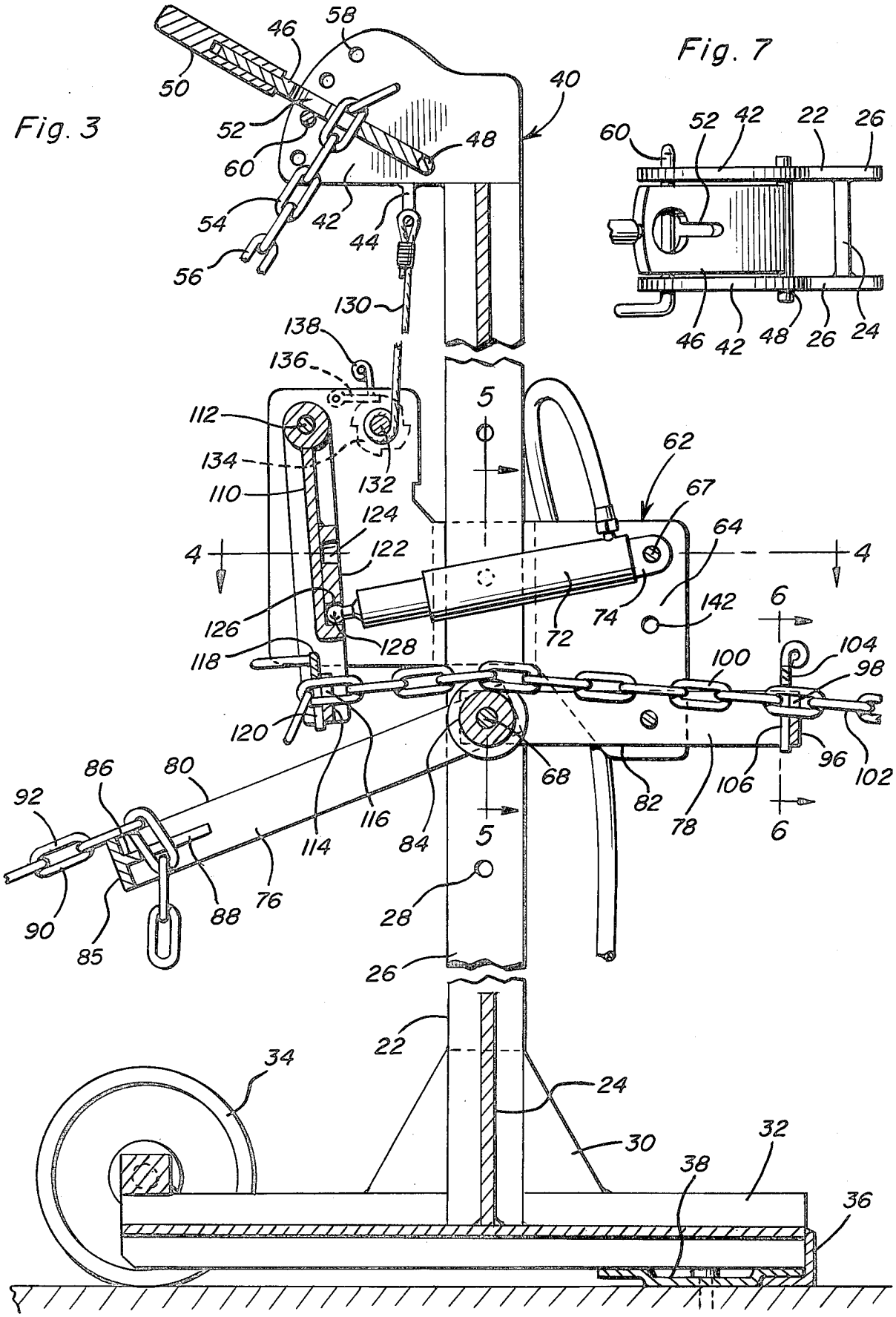
FIG. 3 is a further enlarged vertical sectional view taken substantially upon the plane indicated by the section line 3—3 of FIG. 2.
FIG. 7 is a top plan view of the upper end of the post portion of the pull assembly.

Referring now more specifically to the drawings the numeral 10 generally designates the pull assembly of the instant invention. The assembly 10 is illustrated in FIG. 1 of the drawings in operative association with a vehicle referred to in general by the reference numeral 12 disposed on a shop floor 14 and having its rear end anchored relative to the floor 14 as at 16 through the utilization of a generally horizontal anchor chain 18 having its mid portion braced relative to the floor 14 by a standard 20.

The pull assembly 10 includes an upright post 22 of generally H-shaped cross section including a transverse vertical web 24 which has the central height portion thereof removed whereby the upper and lower ends of the post 22 are connected only by the opposite side flanges 26 thereof extending throughout the vertical mid portion of the post 22.

The flanges 26 include vertically spaced pairs of transversely aligned bores 28 formed therein and the lower end of the post 22 is suitably braced as at 30 to a horizontal base 32 equipped with support wheels 34 on its rear end and a floor anchor engaging angle member 36 on its front end releasably engageable with a floor anchor 38 of conventional design.

The upper end of the post 22 supports a head assembly referred to in general by the reference numeral 40 and including a pair of opposite side plates 42 mounted atop the flanges 26 and interconnected immediately rearwardly of the post 22 by a U-shaped connecting member 44. An elongated plate-type lever 46 has one end thereof pivotally supported between the plates 42 as at 48 and the other end of the lever 46 is provided with a hand grip 50. The mid portion of the lever 46 has a key hole opening 52 formed therein for anchoring relative to selected links 54 of a link chain tension member 56 and the plates 42 have pairs of registered bores 58 formed therethrough and a lock pin 60 is provided and securable through a selected pair of bores 58 below the lever 46 in order to limit counter clockwise swinging of the lever 46 as viewed in FIG. 3 of the drawings.

A follower referred to in general by the reference numeral 62 is provided and the follower 62 includes a pair of opposite side plates 64 which include central horizontally offset vertically extending portions 66 guidingly engaged with the remote sides of the flanges 26, the plates 64 being interconnected by bolts 67 and 68 secured therethrough. The bolt 67 includes a pair of spacer sleeves 70 disposed thereon and one end of a longitudinally extendible fluid cylinder 72 is provided with a mounting ear 74 through which the bolt 67 passes and which is disposed intermediate the adjacent ends of the spacing sleeves 70. In this manner, the fluid cylinder 72 has one end thereof pivotally supported between the plates 64.

The bolt 68 is secured through a corresponding pair of the bores 28 as well as the free ends of the arm portions or legs 76 and 78 of a pair of U-shaped frames 80 and 82 and a guide sheave 84, the legs 76 and 78 being disposed inwardly of the plates 64 and the guide sheave 84 being disposed between the overlapped free ends of the legs 76 and 78.

The U-shaped frame 80 includes a bight portion 85 extending between the ends of the legs 76 thereof remote from the bolt 86 and the bight portion 85 is braced by a bracing plate 86 having a notch 88 formed therein by which to engage selected links 90 of a link chain tension member 92. The tension members 56 and 92 are downwardly inclined away from the head 40 and the frame 80 and have their lower ends anchored relative to a suitable floor anchor 94, see FIG. 1.

The U-shaped frame 82 includes a bight portion 96 extending between the ends of the legs 78 remote from the bolt 68 and the bight portion 96 is equipped with an upwardly opening notch 98 for engaging selected links 100 of a horizontal tension member defining link chain 102. In addition, a notched anchor plate 104 is provided and is equipped with a downwardly opening notch 106 to be used in conjunction with the notch 98 in the bight portion 96 for engaging a selected link 100 of the link chain 102. The link chain 102 extends from a forward frame or body portion of the vehicle 12 as illustrated in FIG. 1 of the drawings toward the follower 62 and passes through the notches 98 and 106 and over the sheave 84. The rear ends of the plates 64 pivotally support the upper end of a depending lever 110 therebetween as at 112 and the lower end of the lever includes a notched anchor plate 14 including an upwardly opening notch 116 formed therein. An anchor plate 118 corresponding to the anchor plate 104 and provided with a downwardly opening notch 120 is provided for utilization in conjunction with the plate 114 for engaging a selected link 100 of the link chain 102.

From FIG. 3 of the drawings it will be noted that the intermediate length portion of the lever 110 includes an anchor plate 122 supported therefrom and that the anchor plate 122 defines a pair of outwardly opening recesses 124 and 126 spaced longitudinally of the lever 110 and in which a spherical end member 128 on the end of the fluid cylinder 72 remote from the bolt 67 may be selectively engaged.

One end of a lifting cable 130 is anchored to the connecting member 44, see FIG. 3, and the other end of the lifting cable 130 is wound about a winding spool 132 extending between and journaled from the plates 64 and having a ratchet wheel 134 on one end with which a pivoted latching dog 136 supported from one of the plates 64 may be engaged. The latching dog 136 is equipped with a finger engageable operating lever 138 and the end of the winding spool 132 remote from the latching dog 136 is equipped with a crank handle 140 for manually turning the winding spool 132.

In operation, the post 22 may be engaged with and anchored to the floor 14 by the anchor 38 and the follower 62 may be adjusted in height as desired by turning the winding spool 131 until the bolt 68 registers with a selected pair of aligned bores 28. Then, the bolt may be passed through the bores 28 in order to lock the follower 62 in adjusted position on the post 22. Thereafter, the chains or tension members 56 and 92 may be adjusted as desired and anchored relative to the anchor 94. In this manner, the intermediate portion of the post 26, the follower 62 and the upper end of the post 22 will be anchored relative to the floor at 94. Thereafter, the link chain 102 may be engaged with the frame or body portion of the vehicle 12 upon which a horizontal pull is to be exerted and the end of the chain 102 remote from the vehicle 12 may be engaged with the lever 110 as at 120. Then, the terminal end 128 of the fluid cylinder 72 may be selectively engaged in either the notch or recess 124 or the recess 126. Extension of the fluid cylinder 72 will then effect a pull on the chain 102 and thus the portion of the vehicle 12 to which the chain 102 is anchored. After the maximum stroke of the cylinder 72 has been achieved, the abutment plate 104 may be utilized in conjunction with the bight portion 96 to lock the chain 102 in position relative to the pull assembly 10, the fluid cylinder 72 may be retracted and the end of the chain 102 remote from the vehicle 12 may be reengaged with the lever 110. Thereafter, the fluid cylinder 72 may again be extended to exert a further pull on the chain 102.

The tension member or chain 56 may be tightened in a manner which is believed to be obvious from FIG. 3 of the drawings through the utilization of the lever 46 and the lock pin or bolt 60 and the bolt 67 may be passed, if desired, through lower registered bores 142 formed in the plates 64.

Through the utilization of the pull assembly 10 a horizontal pull at a selected elevation may be effected and a continuous horizontal pull in a succession of short horizontal pulls may be effected through the utilization of a short stroke fluid cylinder. In addition, the mechanical leverage of the fluid cylinder 72 acting upon the chain 102 may be adjusted and the pull assembly is readily adaptable for use in conjunction with existing conventional floor anchors.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pull assembly for applying a straightening pull on a frame or body portion, said assembly including a vertically elongated support for mounting from a suitable floor surface, a follower mounted on said support for adjustable positioning therealong, said vertically elongated support including first vertically spaced horizontal opening means, said follower including second horizontal opening means selectively registrable with said first horizontal opening means, horizontal pin means removably passed through said second opening meanings and a selected first opening means registered therewith releasably retaining said follower in adjusted position on said support, vertically swingable first elongated arm means including a first end pivotally anchored to said pin means and a second end projecting outwardly from one side of said support and including first anchor means for anchoring to free end of a floor anchored elongated tension member thereto, second elongated horizontal arm means including a first end anchored relative to said pin means and the second end projecting outwardly from the side of said support opposite said one side thereof, a vertically elongated pull lever pivotally supported at its upper end from said follower for limited oscillation about an axis transverse to said lever, support and arm means and with said lever generally paralleling said support, an elongated pull member, second anchor means carried by the lower end of said lever for selectively anchoring one end of said pull member thereto, said second anchor means being generally horizontally aligned with said second end of said second arm means, said second end of said second arm means including third anchor means for releasably engaging and anchoring longitudinally spaced portions of said pull member relative thereto, and an adjustable anchored elongated horizontal and longitudinally extendible thrust means having one end pivotally anchored relative to said follower and the other end engaged with said other end of said lever for angularly displacing the latter relative to said follower in a direction to effect a pull on said pull member extending inwardly along said second arm means from said second end thereof toward the first end thereof.

2. The pull assembly of claim 1 including force means operatively connected between said follower and the upper end of said support for adjustably raising and lowering said follower along said support.

3. The pull assembly of claim 2 wherein said force means includes cable winch means operatively connected between said follower and the upper end of said support.

4. The pull assembly of claim 1 wherein said other end of said lever includes longitudinally spaced areas thereof provided with structure for selective engagement by said other end of said thrust means.

5. The pull assembly of claim 4 wherein said support comprises an upstanding post having means on its lower end for anchoring to a floor mounted structure.

6. The pull assembly of claim 5 wherein the upper end of said post includes means for establishing an inclined tension brace between the upper end of said post and a floor mounted anchor.

* * * * *

UNITED STATES PATENT AND TRADEMARK OFFICE

CERTIFICATE OF CORRECTION

PATENT NO. : 4,475,716

DATED : October 9, 1984

INVENTOR(S) : DAVIS R. JARMAN AND VIRGIL H. HINSON

It is certified that error appears in the above-identified patent and that said Letters Patent is hereby corrected as shown below:

On the title page, [19] delete "Jarmin" and substitute --Jarman--, same page [76] delete "Jarmin" and substitute --Jarman--.

Signed and Sealed this

*Ninth* Day of *April 1985*

[SEAL]

*Attest:*

DONALD J. QUIGG

*Attesting Officer* *Acting Commissioner of Patents and Trademarks*